US005918608A

United States Patent [19]

Renna

[11] Patent Number: 5,918,608

[45] Date of Patent: Jul. 6, 1999

[54] COSMETIC SAMPLER

[75] Inventor: Douglas J. Renna, Valley Stream, N.Y.

[73] Assignee: Cosmetic Sampling Technologies, Inc., Hauppauge, N.Y.

[21] Appl. No.: 09/072,547

[22] Filed: May 5, 1998

[51] Int. Cl.[6] ..... A45D 40/26; B65D 75/00; G09F 15/00

[52] U.S. Cl. ..... 132/320; 206/823; 283/56

[58] Field of Search ..... 132/320; 283/56; 206/823, 209, 581

[56] References Cited

U.S. PATENT DOCUMENTS

| | | | |
|---|---|---|---|
| 4,747,782 | 5/1988 | Campbell, Jr. | 434/377 |
| 4,824,143 | 4/1989 | Grainger | 283/56 |
| 4,876,136 | 10/1989 | Chang et al. | 132/320 |
| 4,884,719 | 12/1989 | Levine et al. | 211/25 |
| 4,890,872 | 1/1990 | Parrotta et al. | 283/56 |
| 5,031,647 | 7/1991 | Seidler | 132/320 |
| 5,161,688 | 11/1992 | Muchin | 206/484 |
| 5,562,112 | 10/1996 | Gunderman et al. | 132/333 |
| 5,622,263 | 4/1997 | Greenland | 206/581 |
| 5,647,941 | 7/1997 | Gunderman et al. | 156/277 |
| 5,690,130 | 11/1997 | Gunderman et al. | 132/319 |

*Primary Examiner*—John J. Wilson
*Assistant Examiner*—Trang Doan
*Attorney, Agent, or Firm*—Collard & Roe, P.C.

[57] ABSTRACT

A cosmetic sampler comprising three panels connected to each other via scored hinges. There is an application tip cut into the second or middle panel that extends upward from a first end panel when the middle and first end panels are folded against each other. A single dose of a cosmetic product is deposited on the tip. A third end panel extends from the middle panel and has a hole cut therethrough. The hole directly overlies the tip when the third end panel is folded over the other two panels so the cosmetic is visible through the hole. The sampler is maintained in a folded state where the third end panel overlies the other two panels until the sampler is used. At this point, the sampler is opened and the first end panel is folded back from the middle panel to allow the user to apply cosmetic from the tip directly to their skin.

11 Claims, 2 Drawing Sheets

COSMETIC SAMPLER

BACKGROUND OF THE INVENTION

1. Field of the Invention

This invention relates to a cosmetic sampler containing a single application of cosmetic product. In particular, this invention relates to a cosmetic sampler formed from a single sheet of paperboard that safely stores a single application of cosmetic product, and which converts into a convenient applicator as well.

2. The Prior Art

Consumers of cosmetics usually like to sample a particular product prior to purchasing it, to test the color or fragrance on their skin. Many consumers do not like to use the full-size "tester" products provided in the stores, due to fear of contamination by other shoppers.

There have been many attempts to construct disposable cosmetic samplers that provide only a single-application of cosmetic product. Some of the more commonly seen ones are the tiny vials of perfume or perfume tester strips. Other tester strips often include cosmetic samples such as eye shadow or blusher whose consistency has been altered for packaging purposes.

Other samplers comprise a perforated paper strip with a dose unit of product deposited between each perforation and sealed with a transparent sealing strip. Such a sampler is shown in U.S. Pat. No. 4,884,719 to Levine et al.

Another type of sampler is shown in U.S. Pat. No. 4,824,113 to Grainger, which shows a series of folded panels with a dose of a cosmetic product deposited on one of the panels. A window on another panel overlies the product when the panels are folded up, so the consumer can see the color of the product. Another sampler is shown in U.S. Pat. No. 5,161,688 to Muchin. This sampler is made by punching a hole in a laminate having backing and covering layers, to create a reservoir for holding a portion of product. A film is applied on top of the hole to keep the product inside. Yet another sampler is disclosed in U.S. Pat. No. 4,747,782 to Campbell, Jr. which shows the product deposited on a folded sheet having a barrier.

The drawback of all of these samplers is that they do not provide a convenient way for the consumer to apply the cosmetic. Separate tools or fingers must be used to apply the cosmetic from these samplers to the user's face. A sampler with an integral applicator is shown in U.S. Pat. No. 5,690,130 to Gunderman et al. However, this applicator is a separate piece that is broken off of the package and used to apply the cosmetic.

SUMMARY OF THE INVENTION

It is therefore an object of the present invention to provide a cosmetic sampler that allows the consumer to easily apply the cosmetic directly to their face or body.

It is another object of the present invention to provide a cosmetic sampler that does not require the original cosmetic product to be altered for sampling.

It is another object of the present invention to provide a cosmetic sampler that supplies a single application of cosmetic in a hygienic and attractive package.

It is yet another object of the present invention to provide a cosmetic sampler that is small and easily stackable in large quantities.

It is a further object of the present invention to provide a cosmetic sampler that is simple and inexpensive to manufacture.

These and other objects of the present invention are achieved by a cosmetic sampler comprising three panels connected to each other via scored hinges. There is an application tip cut into the second or middle panel that extends upward from a first panel when the first and second panels are folded against each other.

A single dose of an oleaginous-based cosmetic product is deposited on the tip. A third panel extends from the second panel and has a hole cut therethrough. The hole directly overlies the tip when the third panel is folded over the other two panels so the cosmetic product is visible through the hole.

The sampler is maintained in a folded state where the third panel overlies the other two panels until the sampler is used. At this point, the sampler is opened and the first panel is folded back from the second panel to allow the user to apply cosmetic from the tip directly to their skin.

The panels are integrally formed from a single sheet of paperboard or other suitable material and are separated from each other by scored hinges. The sampler can be cut in multiples separated by perforations from a single large sheet of paperboard, and shipped flat. The sampler is easily assembled at a final destination. Even in the folded state, the sampler is extremely flat and compact, so large quantities of the sampler are easily stored behind a cosmetic counter, or included in direct mailings or even inside magazines.

The tip and preferably the entire inside surface of the sampler is coated with a material for preventing the cosmetic product from bleeding once it is applied to the tip. This material could comprise an organic polymer such as polyvinylidene chloride, polyvinyl chloride, cellophane, polypropylene or polyethylene, or any other substance that has an affinity for the cosmetic product and which will prevent bleeding of the cosmetic. Having an affinity for the product is necessary so that the product adequately adheres to the sampler.

The sampler is kept in a folded state by a translucent adhesive strip that overlies the hole in the third panel and extends out from the third panel to secure the third panel closed over the first and second panels. This strip not only keeps the sampler folded but provides a translucent protective window over the hole to prevent access to the cosmetic product.

Preferably, the tip is semicircular and the hole is round. However, other shapes such as square, rectangular, triangular, or irregular shapes could be envisioned. The round shape of the tip is preferable because it creates a smooth and convenient shape for applying the cosmetic product directly to the skin from the tip. This is especially important if the product is lipstick, where it is necessary to apply the product with precision and comfort.

The cosmetic products can be deposited in a premolded state onto the tips in a completely automated fashion, thus enabling the sampler to be produced efficiently in large quantities.

While the sampler according to the invention is ideally constructed to be a lipstick sampler, other products could be affixed to the sampler as well. For example, pressed powder, blusher, wax-based perfume, base makeup and eye shadow could also be used. The present invention allows these products to be sampled in their original state, so no alterations of the texture and color of the products occur. Additionally, it could also be envisioned that the sampler according to the invention could also be used to sample topical medications. The only requirement is that the product have a sufficiently solid consistency so as to maintain its shape and position on the applicator tip.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
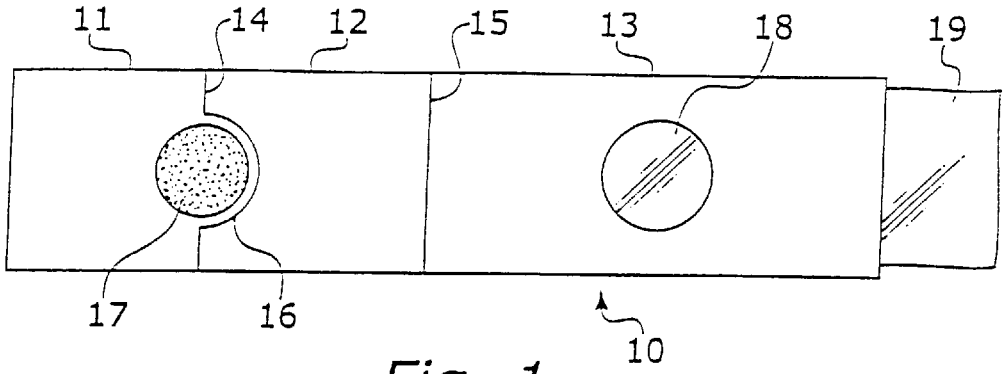
FIG. 1 shows a front view of the sampler according to the invention in a completely unfolded state.
Figure 2:
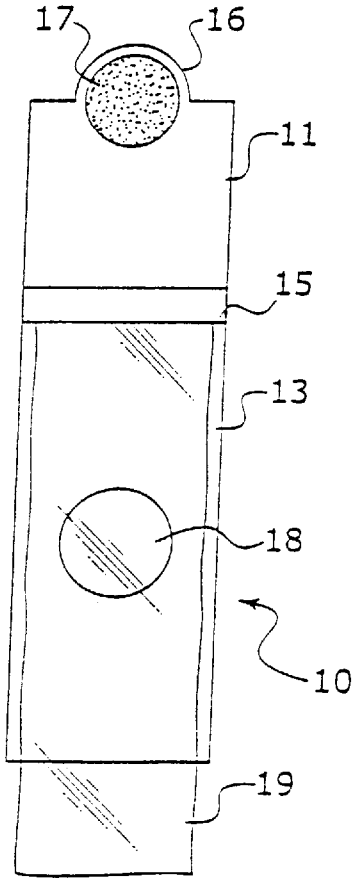
FIG. 2 shows a front view of the sampler with the first panel folded back and the tip in position for application of a cosmetic product.
Figure 3:
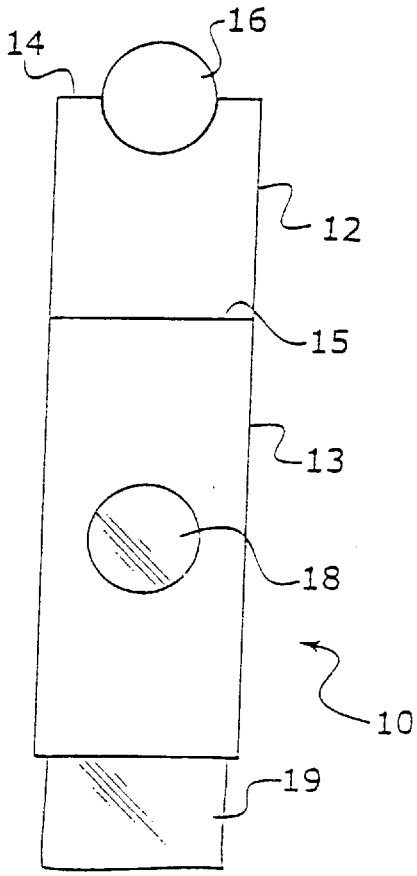
FIG. 3 shows a rear view of the sampler shown in FIG. 2.

Referring now in detail to the drawings and, in particular, FIGS. 1–3, there is shown one embodiment of a cosmetic sampler 10 according to the invention. Sampler 10 is comprised of a first panel 11, a second panel 12, and a third panel 13, all formed from a single sheet and separated by scored hinges 14 and 15, respectively.

Figure 4:
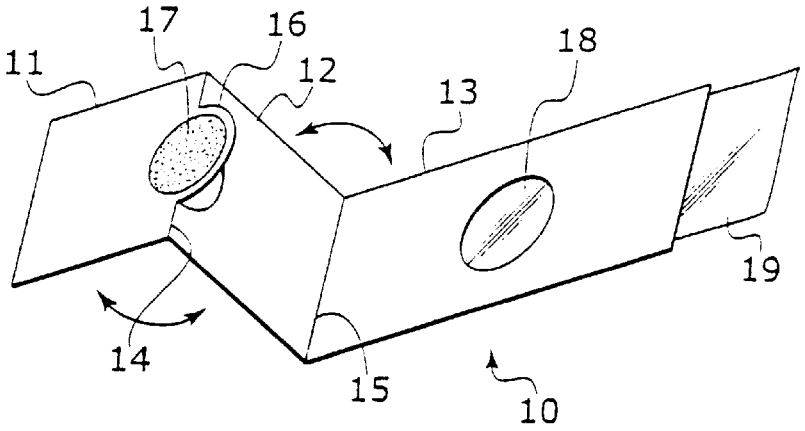
FIG. 4 shows a perspective view of the sampler according to the invention in a partially unfolded state.

A cosmetic application tip 16 is cut into second panel 12 so that when first panel 11 is folded back on second panel 12 as shown in FIGS. 2–4, tip 16 protrudes from sampler 10 to provide a convenient applicator for cosmetics. Tip 16 holds a single application of cosmetic product 17, such as lipstick, which can be applied to the user's lips directly from tip 16. Tip 16 is preferably coated with a polymeric barrier to prevent cosmetic product 17 from bleeding through.

Figure 5:
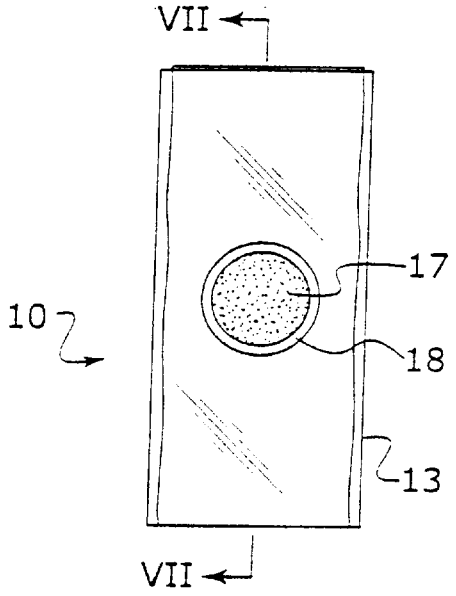
FIG. 5 shows a front view of the sampler according to the invention in a folded state.
Figure 6:
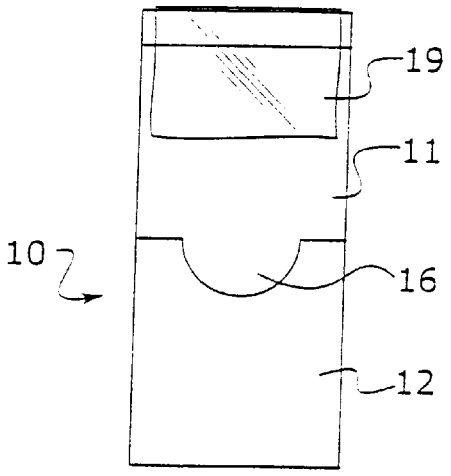
FIG. 6 shows a rear view of the sampler shown in FIG. 5.
Figure 7:
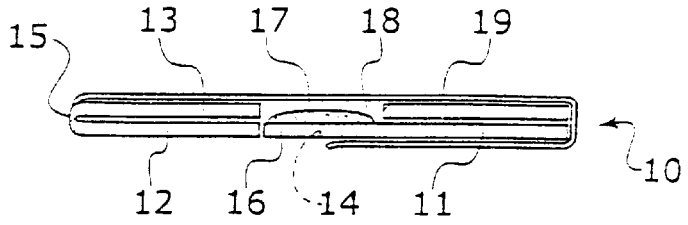
FIG. 7 shows a cross-sectional view along lines VII—VII of the sampler shown in FIG. 6.

Third panel 13 is provided with a hole 18, which directly overlies tip 16 and cosmetic product 17 when third panel 13 is folded over first panel 11 and second panel 12, as shown in FIGS. 5–7. Third panel 13 is also covered with a translucent adhesive strip 19, which covers hole 18 as shown in FIG. 5, and provides a securing tab to keep sampler 10 in a folded state prior to use, as shown in FIGS. 6 and 7.

Strip 19 prevents access to cosmetic product 17 prior to sampler 10 being opened, yet allows the product to be visible to the user. This way, the user can choose from several different colors of product to sample without having to open any package, and keeps all of the samples sanitary. Cosmetic product 17 is deposited onto sampler 10 in its original unadulterated state, so the user can sample the exact product sold, with no changes in color or consistency.

In its folded state, sampler 10 is extremely flat and small and thus can be stored in large quantities without occupying a lot of space. For example, the sampler could be produced having dimensions of 1 in.×0.5 in.×0.1 in. in its folded state, and still be large enough for convenient application. This is especially important if the sampler is to be used at crowded cosmetic counters, or in a magazine insert.

Accordingly, while only one embodiment of the present invention have been shown and described, it is obvious that many changes and modifications may be made thereunto without departing from the spirit and scope of the invention.

What is claimed is:

1. A cosmetic sampler comprising:

a first panel;

a second panel connected to the first panel along one edge;

a tip cut into the second panel to define an applicator for receiving a cosmetic product, said tip being integrally formed with the first panel and extending into the second panel, said tip extending upward from the first panel when the first and second panels are folded together;

a third panel connected to said second panel at an edge opposite the edge connected to the first panel, said third panel having a hole cut therethrough, said hole overlying said tip when said third panel is folded over said first and second panels so that said tip is visible through said hole; and means for maintaining the sampler in a folded state wherein the third panel is folded over said first and second panels;

wherein cosmetic product deposited on said tip is applied by unfolding said third panel and folding said first panel behind said second panel so that said tip protrudes from the sampler.

2. The cosmetic sampler according to claim 1, wherein the panels are integrally formed from a single sheet and are separated from each other by scored hinges.

3. The cosmetic sampler according to claim 1, wherein said tip is coated with means for preventing cosmetic product from bleeding therethrough.

4. The cosmetic applicator according to claim 1, wherein the means for maintaining the sampler in a folded state comprises an adhesive strip.

5. The cosmetic sampler according to claim 4, wherein the adhesive strip is translucent and overlies the hole in the third panel and extends out from the third panel to secure the third panel closed over said first and second panels.

6. The cosmetic sampler according to claim 1, wherein said tip is semicircular.

7. The cosmetic sampler according to claim 1, further comprising a measured amount of cosmetic product deposited on said tip.

8. The cosmetic sampler according to claim 1, wherein the hole is round.

9. The cosmetic sampler according to claim 1, wherein the panels are made from paperboard.

10. The cosmetic sampler according to claim 7, wherein the cosmetic product is lipstick.

11. The cosmetic sampler according to claim 1, wherein said hole is covered by a translucent material to prevent access to said tip when said sampler is in the folded state.

* * * * *